US010463128B1

(12) United States Patent
Kaspian

(10) Patent No.: US 10,463,128 B1
(45) Date of Patent: Nov. 5, 2019

(54) THEFT PREVENTION SECURITY DEVICE FOR INSTRUMENTS

(71) Applicant: Paul Edward Kaspian, Morro Bay, CA (US)

(72) Inventor: Paul Edward Kaspian, Morro Bay, CA (US)

( * ) Notice: Subject to any disclaimer, the term of this patent is extended or adjusted under 35 U.S.C. 154(b) by 0 days.

(21) Appl. No.: 16/118,130

(22) Filed: Aug. 30, 2018

Related U.S. Application Data

(60) Provisional application No. 62/584,454, filed on Nov. 10, 2017.

(51) Int. Cl.
*A45C 13/20* (2006.01)
*G10G 7/00* (2006.01)

(52) U.S. Cl.
CPC ..... *A45C 13/20* (2013.01); *G10G 7/005* (2013.01)

(58) Field of Classification Search
CPC ..... A45C 13/20; G10G 7/005
See application file for complete search history.

(56) References Cited

U.S. PATENT DOCUMENTS 4,526,125 A * 7/1985 Bain, Jr. ..... E05B 73/007 114/172
4,712,394 A * 12/1987 Bull ..... E05B 73/0005 441/74
4,765,521 A * 8/1988 Finnegan ..... B60R 9/048 224/315
4,867,478 A * 9/1989 Anderson ..... A63C 11/005 280/814
4,896,519 A * 1/1990 Pitts ..... B60R 9/08 70/18
5,095,722 A * 3/1992 Chapmond ..... B60R 9/048 114/172
8,684,760 B1 * 4/2014 Lam ..... H01R 13/6276 174/135
2009/0113946 A1 * 5/2009 Baumgarten ..... E05B 67/006 70/18
2012/0125494 A1 * 5/2012 Avganim ..... A45C 13/20 150/101
2012/0137741 A1 * 6/2012 Yu ..... B62H 5/003 70/53
2015/0152669 A1 * 6/2015 Kindstrand ..... E05B 73/0005 70/15
2016/0348403 A1 * 12/2016 Denny ..... E05B 73/0005

* cited by examiner

*Primary Examiner* — Robert Sandy
*Assistant Examiner* — David M Upchurch
(74) *Attorney, Agent, or Firm* — Plager Schack LLP; Mark H. Plager; Kara Verryt

(57) ABSTRACT

A security device for preventing theft of an instrument may include a primary cord having a first looped end and a second looped end; a secondary cord connected to the primary cord proximate to the first looped end and the second looped end; and an internal support cable attached to a central portion of both the primary cord and the secondary cord. The first looped end and the second looped end may be designed to be locked together to secure the security device around the instrument.

8 Claims, 2 Drawing Sheets

THEFT PREVENTION SECURITY DEVICE FOR INSTRUMENTS

RELATED APPLICATION

This application claims priority to provisional patent application U.S. Ser. No. 62/584,454 filed on Nov. 10, 2017, the entire contents of which is herein incorporated by reference.

BACKGROUND

The embodiments herein relate generally to musical instruments, and more particularly, to a security system to prevent theft of a musical instrument.

Musical instruments are valuable from not only a monetary standpoint, but also from an emotional and sentimental standpoint. For years, musicians have been unable to protect their instruments from theft, both at home and in transit. Designing a security system for musical instruments is challenging given their unique shape and their inherent lack of anchor points on the instrument or the instrument's case versus an object like a bicycle, wherein a tether may simply be extending through the frame and secured.

A lack of a sufficient security system forces many musicians to put their instruments in situations that can cause them damage, such as by storing an instrument in an automobile trunk. This provides the additional security to the instrument, but exposes instruments to extremes in heat and cold, which can damage the instruments.

Therefore, what is needed is a security system that overcomes the unique physical challenges of securing musical instruments, enabling musicians to secure their instruments in a variety of environments.

SUMMARY

Some embodiments of the present disclosure include a security device for preventing theft of an instrument. The security device may include a primary cord having a first looped end and a second looped end; a secondary cord connected to the primary cord proximate to the first looped end and the second looped end; and an internal support cable attached to a central portion of both the primary cord and the secondary cord. The first looped end and the second looped end may be designed to be locked together to secure the security device around the instrument

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
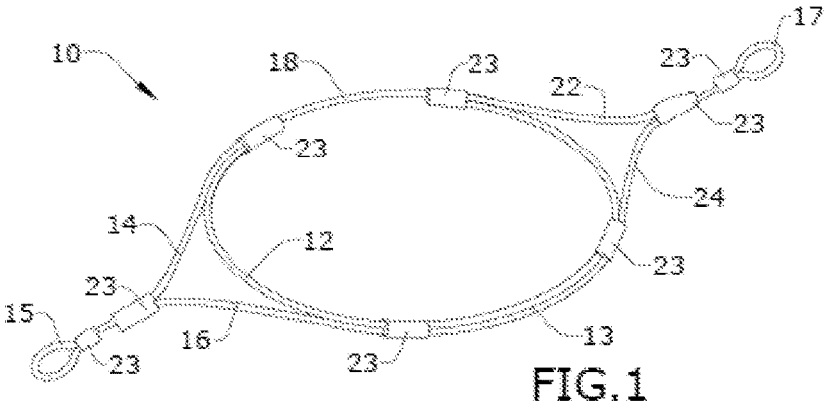
FIG. 1 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to prevent theft of an instrument and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

a. Primary Cord
b. Secondary Cord
c. Internal Loop
d. Connectors
e. End Loops
f. Accessory Cord The various elements of the device of the present disclosure may be related in the following exemplary fashion. It is not intended to limit the scope or nature of the relationships between the various elements and the following examples are presented as illustrative examples only.

By way of example, and referring to FIGS. 1-5, some embodiments of the present disclosure include a security device 10 for preventing theft of an instrument 11, the security device 10 comprising a primary cord 18 having a first looped end 15 and a second looped end 17; a secondary cord 13 connected to the primary cord 18 proximate to both the first looped end 15 and the second looped end 17; and an internal support cable 12 attached to a central portion of both the primary cord 18 and the secondary cord 13. The device 10 may further comprise a lock, such as a padlock 26, to secure the first looped end 15 to the second looped end 17, locking the security device 10 around the instrument 11. In some embodiments, the device 10 may further comprise an accessory cable 28 designed to removably secure the instrument 11 to a separate object, such as a post 30. In such embodiments, the accessory cable 28 may include a first accessory cable loop 25 at a first end thereof and a second accessory cable loop 27 at a second end thereof, wherein the second accessory cable loop 27 is sized to fit through the first accessory cable loop 25, such that the accessory cable 28 may be wrapped around a stationary object, such as a post 30 with the second accessory cable loop 27 engaging with the lock 26.

In embodiments, the primary cord 18 may be attached to the secondary cord 13 and the internal support cable 12 via a plurality of connectors 23. For example, a first end 14 of the primary cord 18 may be attached to a first end 16 of the secondary cord 13 by a connector 23, and the second end 22 of the primary cord 18 may be attached to a second end 24 of the secondary cord 13 by a connector 23. The internal support cable 12 may be attached to a central portion of the primary cord 18 by a pair of connectors 23. Additionally, the internal support cable 12 may be attached to a central portion of the secondary cord 13 by a pair of connectors 23. Thus, the internal support cable 12 may have four connectors 23 connecting it to the primary cord 18 and secondary cord 13. However, in other embodiments, the number of connectors 23 may vary. For example, the secondary cord 13 may be attached to the internal support cable 12 by a single connector 23 at a central point of the secondary cord 13. The connectors 23 may comprise any suitable fastener or connector device and, in some embodiments, comprise a wire rope sleeve.

The primary cord 18, secondary cord 13 and internal support cable 12 may comprise any suitable cord material, such as hardened steel cable or wire rope. The lock 26 may be any suitable lock and, in some embodiments, is built into the structure of the security device 10. Alternatively, the lock 26 may be a distinct, separate piece simply designed to engage with the looped ends 15, 17.

Figure 2:
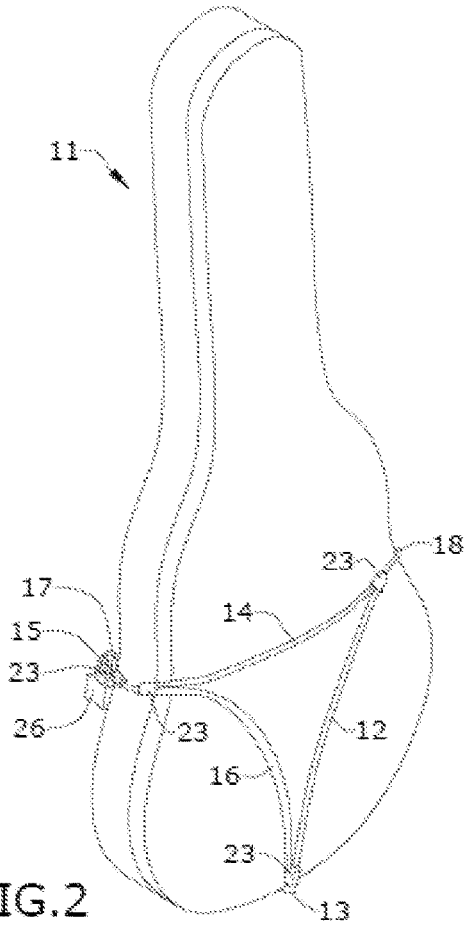
FIG. 2 is a perspective view of one embodiment of the present disclosure, shown in use.
Figure 3:
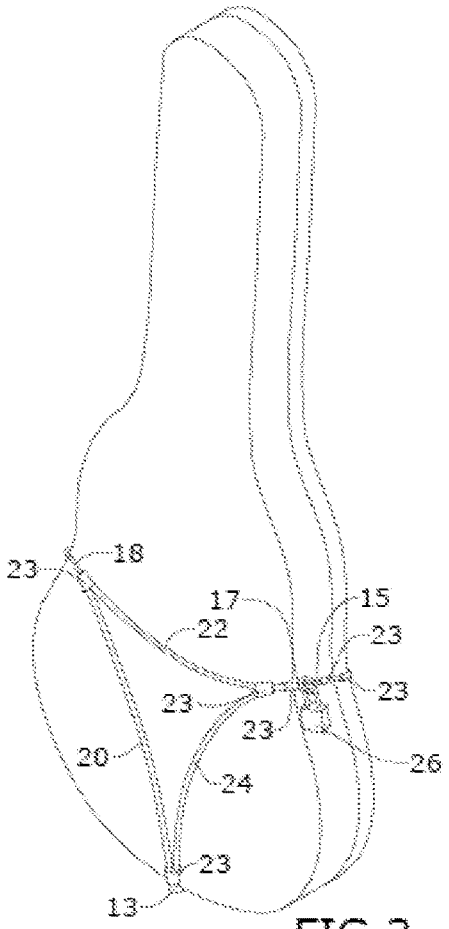
FIG. 3 is a rear perspective view of one embedment of the present disclosure, shown in use.
Figure 4:
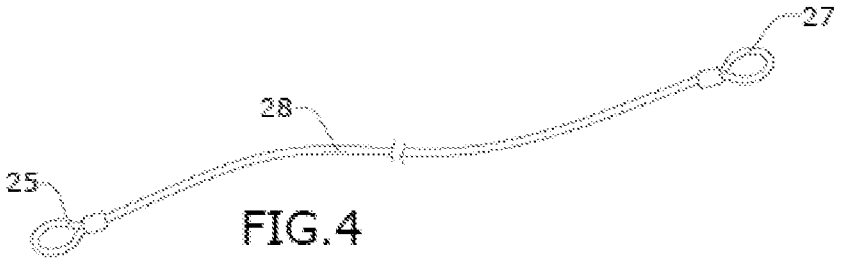
FIG. 4 is a perspective view of one embodiment of the present disclosure.
Figure 5:
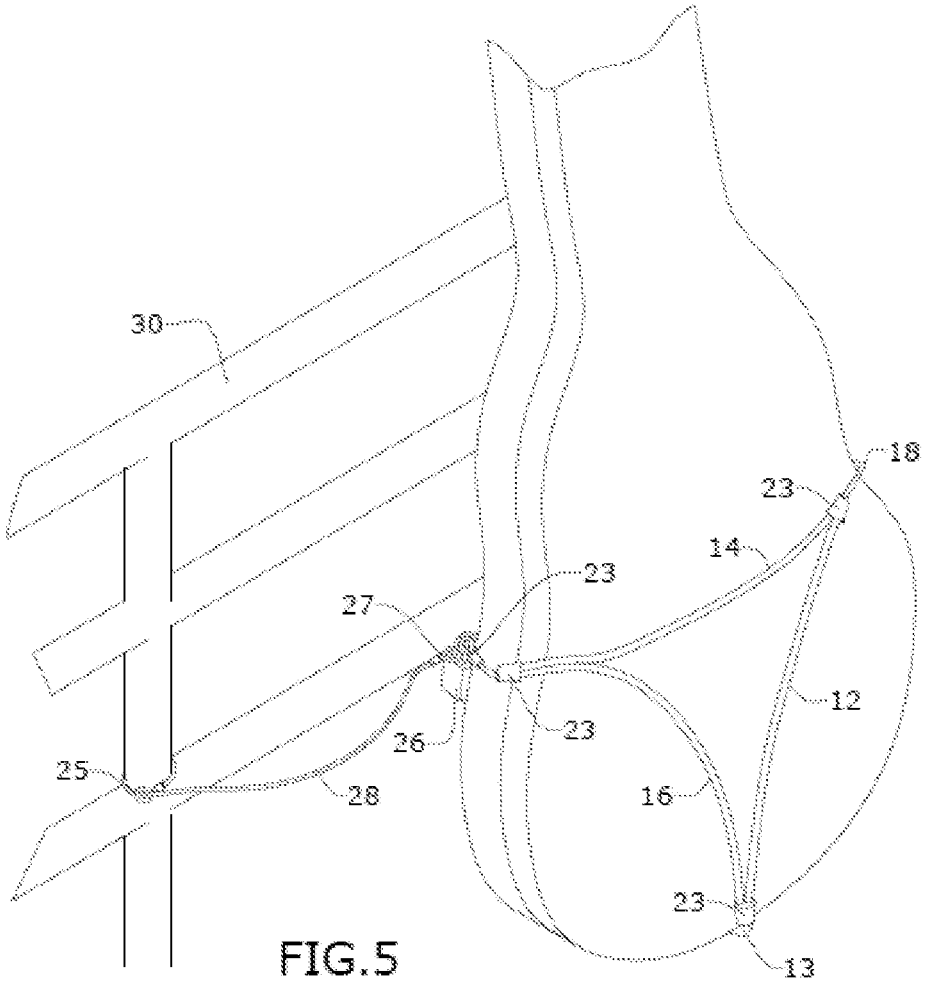
FIG. 5 is a perspective view of one embodiment of the present disclosure, shown in use.

To use the security device 10 of the present disclosure, a user may place the connectors 23 connecting the secondary cord 13 and the internal support cable 12 under a surface of an instrument 11, such as under a bottom surface thereof, as shown in FIGS. 2 and 3. The primary cord 18 may then be wrapped around the instrument 11 (or instrument case) and the looped ends 15, 17 may be locked together using any conventional lock 26. Thus, the security device 10 may be secured around the instrument 11. In embodiments, the primary cord 18 may also be wrapped around a stationary object, such as a post, a railing, or the like, before the looped ends 15, 17 are locked together, securing the instrument to an external structure, such as an inanimate, immovable object. Alternatively, the accessory cable 28 may be used to secure the instrument 11 to the external structure by looping the accessory cable 28 around the object and attaching at least one of the first accessory cable loop 25 or second accessory cable loop 27 to the lock 26, as shown in FIG. 5. Because of the structure of the device 10, the instrument 11 is secured with a quadruple-point design, which prevents the device 10 from be tampered with or removed. Of course, the sizes of the components may vary depending on the instrument to be secured.

Because of the design of the security device 10 and how it is configured with respect to an instrument 11, removal of the security device 10 is prevented (unless being removed by the owner/user), thus securing the instrument 11. In other words, the design of the security device 10 and how it engages with an instrument 11 prevents it from being removed by pulling, sliding, yanking, and the like.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A security device for preventing theft of an instrument, the security device comprising:

a primary cord having a first looped end and a second looped end;

a secondary cord connected to the primary cord proximate to the first looped end and the second looped end; and an internal support cable attached to a central portion of both the primary cord and the secondary cord, wherein the first looped end and the second looped end are designed to be locked together to secure the security device around the instrument.

2. The security device of claim 1, wherein:

the primary cord comprises a first end, a second end, and a central portion between the first end and the second end;

the secondary cord comprises a first end, a second end, and a central portion between the first end and the second end;

the first end of the primary cord is attached to the first end of the secondary cord by a connector; and the second end of the primary cord is attached to the second end of the secondary cord by a connector.

3. The security device of claim 1, wherein the primary cord is attached to the internal support cable by at least a pair of connectors.

4. The security device of claim 1, wherein the secondary cord is attached to the internal support cable by at least one connector.

5. The security device of claim 1, further comprising connectors attaching the primary cord to the secondary cord, the primary cord to the internal support cable, and the secondary cord to the internal support cable, wherein the connectors each comprise a wire rope sleeve.

6. The security device of claim 1, wherein the first looped end and the second looped end each engage with a lock, thus securing the first looped end to the second looped end.

7. The security device of claim 6, further comprising an accessory cable comprising a first accessory cable loop and a second accessory cable loop, wherein:

the second accessory cable loop is sized to fit through the first accessory cable loop and engage with the lock.

8. The security device of claim 1, wherein the primary cord, the secondary cord, and the internal support cable each comprise a member selected from the group consisting of hardened steel cable and wire rope.

* * * * *